US011411356B2

(12) United States Patent
Lee

(10) Patent No.: US 11,411,356 B2
(45) Date of Patent: Aug. 9, 2022

(54) ELECTRICAL CABLE CONNECTOR ASSEMBLY WITH A GROUNDING LAYER CLAMPED TO A CIRCUIT BOARD

(71) Applicant: James Cheng Lee, La Habra, CA (US)

(72) Inventor: James Cheng Lee, La Habra, CA (US)

( * ) Notice: Subject to any disclaimer, the term of this patent is extended or adjusted under 35 U.S.C. 154(b) by 0 days.

(21) Appl. No.: 17/099,778

(22) Filed: Nov. 17, 2020

(65) Prior Publication Data

US 2022/0158390 A1 May 19, 2022

(51) Int. Cl.

| | |
|---|---|
| ***H01R 13/6594*** | (2011.01) |
| ***H01R 13/66*** | (2006.01) |
| *H01R 13/02* | (2006.01) |
| *H01R 13/6595* | (2011.01) |
| *H01R 13/6597* | (2011.01) |

(52) U.S. Cl.
CPC ..... *H01R 13/6594* (2013.01); *H01R 13/6658* (2013.01); *H01R 13/025* (2013.01); *H01R 13/6595* (2013.01); *H01R 13/6597* (2013.01)

(58) Field of Classification Search
CPC ..... H01R 13/6594; H01R 13/6658; H01R 13/025; H01R 13/6595; H01R 13/6597
See application file for complete search history.

(56) References Cited

U.S. PATENT DOCUMENTS

| | | | | |
|---|---|---|---|---|
| 4,192,566 A * | 3/1980 | Laudig | H01R 9/0518 174/91 |
| 4,605,278 A * | 8/1986 | Seidler | H05K 3/3405 439/876 |
| 2017/0294739 A1* | 10/2017 | Pao | H01R 13/6658 |

* cited by examiner

*Primary Examiner* — Abdullah A Riyami
*Assistant Examiner* — Justin M Kratt
(74) *Attorney, Agent, or Firm* — Lin & Associates Intellectual Property, Inc.

(57) ABSTRACT

A cable connector assembly includes a circuit board, a plurality of grounding elements and a plurality of cables. Rear ends of an upper surface and a lower surface of the circuit board are equipped with a plurality of contact pads and a plurality of grounding pads. The plurality of grounding elements are soldered to the plurality of the grounding pads. Two sides of each grounding element have two clamping portions. Each cable includes an inner conductor, an inner insulating layer, a shielding layer and an outer insulating layer arranged in an inside-to-outside direction. The inner conductors of the plurality of the cables are electrically connected with the plurality of the contact pads, the shielding layer of each cable is mounted in one grounding element. The shielding layer of each cable is clamped between the two clamping portions of the one grounding element.

17 Claims, 10 Drawing Sheets

ELECTRICAL CABLE CONNECTOR ASSEMBLY WITH A GROUNDING LAYER CLAMPED TO A CIRCUIT BOARD

BACKGROUND OF THE INVENTION

1. Field of the Invention

The present invention generally relates to a cable connector assembly, and more particularly to a cable connector assembly capable of simplifying a cable grounding mode.

2. The Related Art

With reference to FIG. 10, a cable connector assembly 100' in prior art, includes a circuit board 4'. Rear ends of a top surface and a bottom surface of the circuit board 4' has a plurality of contact pads 41' and a plurality of grounding pads 42'. Each two adjacent contact pads 41' are spaced by one grounding pad 42'. The cable connector assembly 100' is connected with a plurality of cables 3'. Each cable 3' is a coaxial cable. Each cable 3' includes an inner conductor 31', an inner insulating layer 32', a shielding layer 33' and an outer insulating layer 34' arranged from an inside to an outside. The shielding layer 33' has a grounding portion 331' protruding outward. The inner conductor 31' is electrically connected to the plurality of the contact pads 41' of the circuit board 4', and the grounding portion 331' is connected with the plurality of the grounding pads 42'.

However, a cable grounding mode of the cable connector assembly 100' needs to organize a bundle of conductors of the shielding layer 33' into the grounding portion 331' in addition, and the grounding portions 331' of the shielding layers 33' of the plurality of the cables 3' are connected with the plurality of the grounding pads 42' of the circuit board 4' to achieve a grounding effect. The cable grounding mode of the cable connector assembly 100' not only has a complicated manufacturing process, but also requires more soldering space, thereby a quantity of signal lines that can be used to the circuit board 4' is affected, specifically, only five 28 AWG cables can be connected to the circuit board 4'. Moreover, in this cable grounding mode, a part of the inner insulating layer 32' of each cable 3' is exposed outside without being shielded, and each cable 3' is easily interfered.

Therefore, it is necessary to provide an innovative cable connector assembly that is capable of simplifying a cable grounding mode, thereby steps of a manufacturing process and a cost consumption of the innovative cable connector assembly are decreased, and a space utilization rate of the circuit board is increased.

SUMMARY OF THE INVENTION

An object of the present invention is to provide a cable connector assembly. The cable connector assembly includes a circuit board, a plurality of grounding elements and a plurality of cables. Rear ends of an upper surface and a lower surface of the circuit board are equipped with a plurality of contact pads, and a plurality of grounding pads near to the plurality of the contact pads. The plurality of grounding elements are soldered to the plurality of the grounding pads of the circuit board. Two sides of each grounding element have two clamping portions protruded upward. The plurality of the cables are fastened on the circuit board. Each cable includes an inner conductor, an inner insulating layer, a shielding layer and an outer insulating layer arranged in an inside-to-outside direction and in sequence. The inner conductors of the plurality of the cables are electrically connected with the plurality of the contact pads of the circuit board, at the moment, the shielding layer of each cable is mounted in one grounding element. The shielding layer of each cable is clamped between the two clamping portions of the one grounding element, and the shielding layer of each cable is in contact with the two clamping portions of the one grounding element.

Another object of the present invention is to provide a cable connector assembly. The cable connector assembly includes a circuit board, a plurality of grounding elements and a plurality of cables. Rear ends of an upper surface and a lower surface of the circuit board are equipped with a plurality of contact pads, and a plurality of grounding pads near to the plurality of the contact pads. The plurality of the grounding pads are arranged in two rows and along a front-to-rear direction, and the plurality of the contact pads are arranged in two rows and along the front-to-rear direction. The plurality of the contact pads are corresponding to the plurality of the grounding pads. The contact pads in each row are arranged transversely, and the grounding pads in each row are arranged transversely. One row of the grounding pads is located behind the two rows of the contact pads, the other row of the grounding pads is located between the two rows of the contact pads. The plurality of the grounding elements are soldered to the plurality of the grounding pads of the circuit board. Each grounding element has a base portion, and two clamping portions extended upward from two opposite sides of the base portion. The base portion of each grounding element is soldered to one grounding pad of the circuit board. The two clamping portions include two extending arms extended upward from the two opposite sides of the base portion. Upper portions of the two extending arms are arched inwardly and towards each other to form two clamping blocks, respectively. The plurality of the cables are fastened on the circuit board and arranged in two rows along the front-to-rear direction. Each cable includes an inner conductor, an inner insulating layer, a shielding layer and an outer insulating layer arranged in an inside-to-outside direction and in sequence. The inner conductors of the plurality of the cables are electrically connected with the plurality of the contact pads of the circuit board, at the moment, the shielding layer of each cable is mounted in one grounding element, the shielding layer of each cable is clamped between the two clamping portions of the one grounding element, and the shielding layer of each cable is in contact with the two clamping portions of the one grounding element, the two clamping blocks of each grounding element abut against the shielding layer of one cable.

An object of the present invention is to provide a cable connector assembly. The cable connector assembly includes a body, a circuit board, a plurality of grounding elements and a plurality of cables. The circuit board is accommodated in the body. A rear end of at least one surface of the circuit board is equipped with a plurality of contact pads, and a plurality of grounding pads near to the plurality of the contact pads. The plurality of the grounding pads are arranged in two rows and along a front-to-rear direction, and the plurality of the contact pads are arranged in two rows and along the front-to-rear direction. The plurality of the contact pads are corresponding to the plurality of the grounding pads. The contact pads in each row are arranged transversely, and the grounding pads in each row are arranged transversely. One row of the grounding pads is located behind the two rows of the contact pads, the other row of the grounding pads is located between the two rows of the contact pads. The plurality of the grounding elements are accommodated in the body. The plurality of the grounding elements are soldered to the plurality of the grounding pads of the circuit board. Two sides of each grounding element have two clamping portions protruded upward. The plurality of the cables are soldered to the circuit board. The plurality of the cables are received in the body. Each cable includes an inner conductor, an inner insulating layer, a shielding layer and an outer insulating layer arranged in an inside-to-outside direction and in sequence. The inner conductors of the plurality of the cables are electrically connected with the plurality of the contact pads of the circuit board, the shielding layer of each cable is mounted in one grounding element, the shielding layer of each cable is clamped between the two clamping portions of the one grounding element, the shielding layer of each cable is soldered with the one grounding element, and the shielding layer of each cable is in contact with the two clamping portions of the one grounding element.

As described above, the cable connector assembly reaches a grounding effect by virtue of the plurality of the grounding elements being soldered to the plurality of the grounding pads of the circuit board and directly contacting with the shielding layers of the plurality of the cables to be conductive, so the shielding layers of the plurality of the cables have no need of being deliberately arranged into a bundle in addition, and a manufacturing procedure of the cable connector assembly is simpler, and simultaneously, the cable connector assembly simplifies a cable grounding mode. Furthermore, each grounding element is located under the shielding layer of the one cable, so a required space of each cable on the circuit board is reduced, and a space utilization rate of the circuit board is increased correspondingly.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
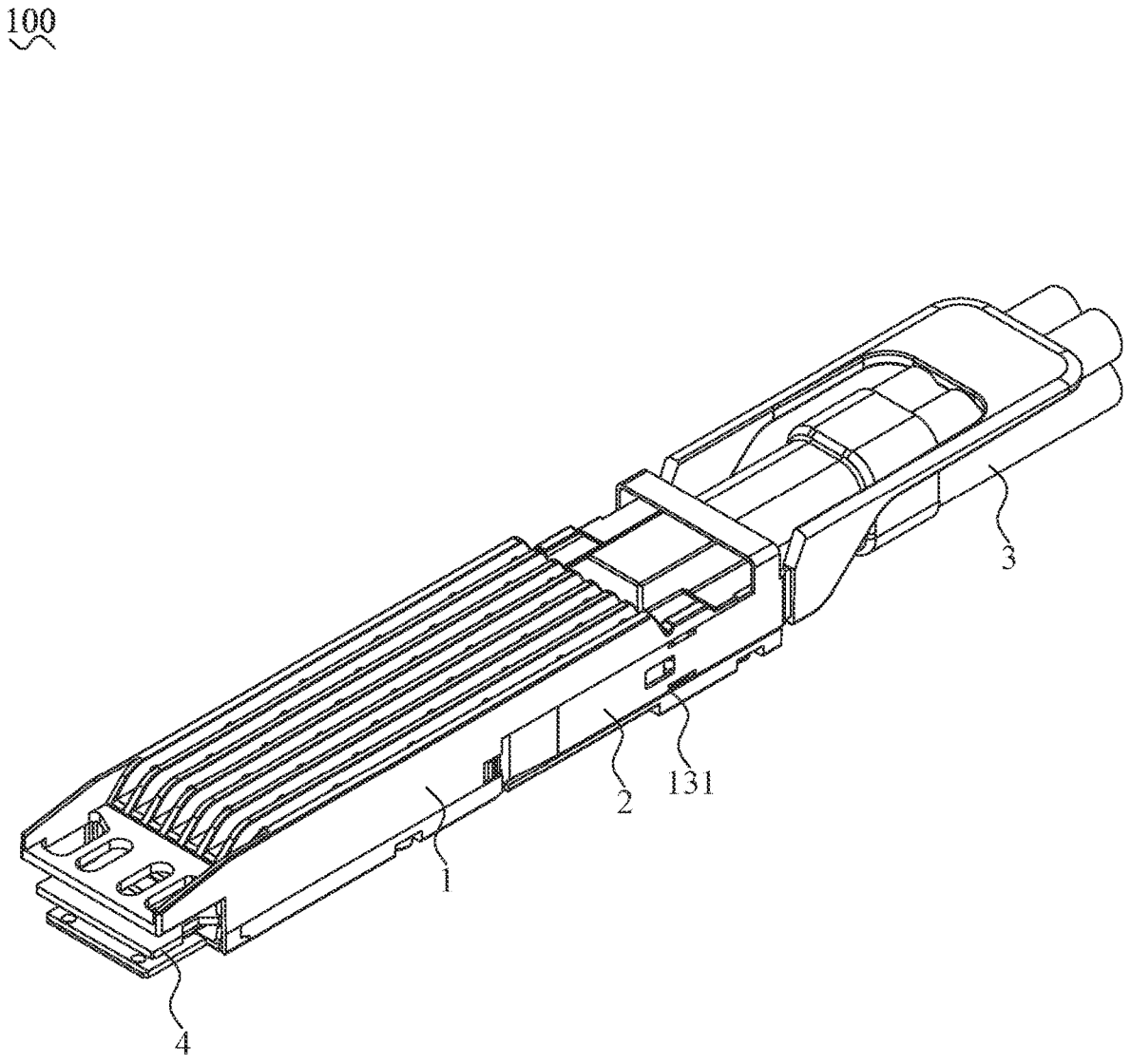
FIG. 1 is a perspective view of a cable connector assembly in accordance with a preferred embodiment of the present invention.
Figure 2:
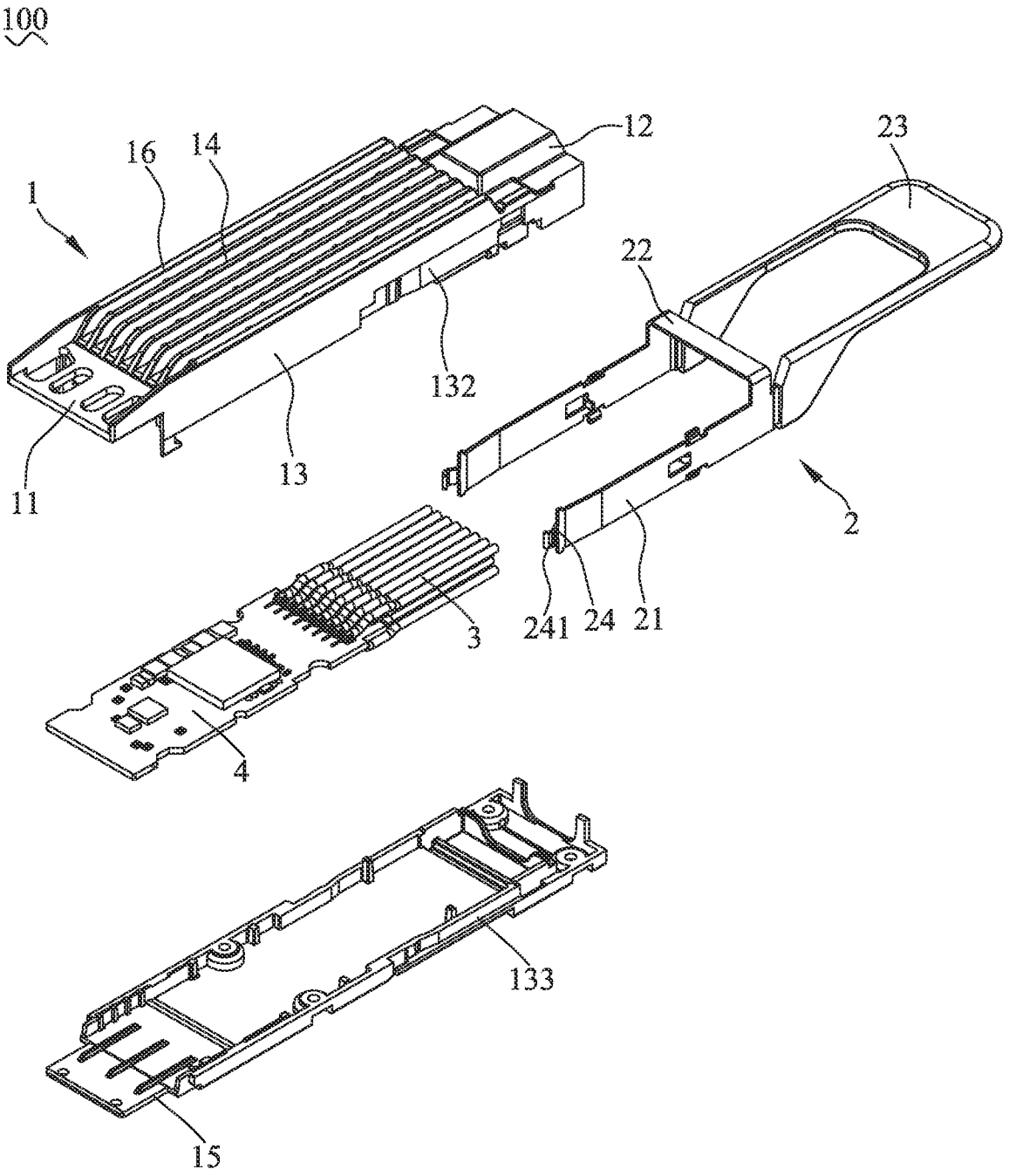
FIG. 2 is an exploded view of the cable connector assembly of FIG. 1.
Figure 9:
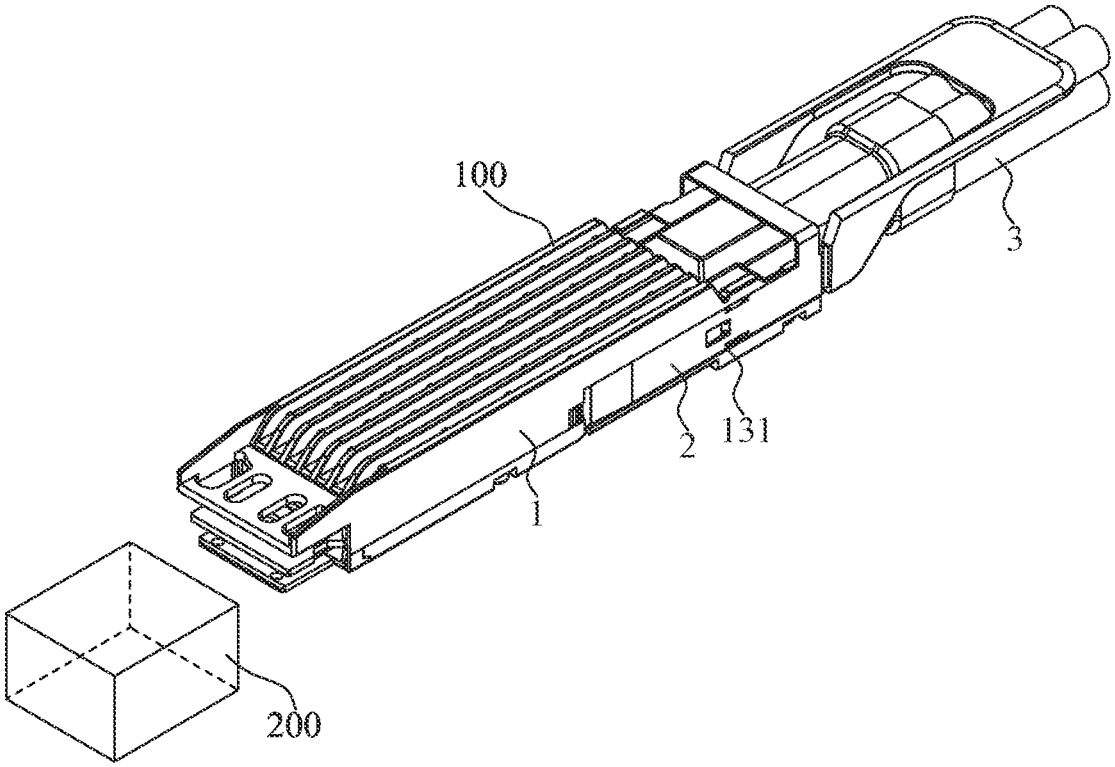
FIG. 9 is a diagrammatic drawing showing that a docking connector is arranged corresponding to the cable connector assembly of FIG. 1.
Figure 10:
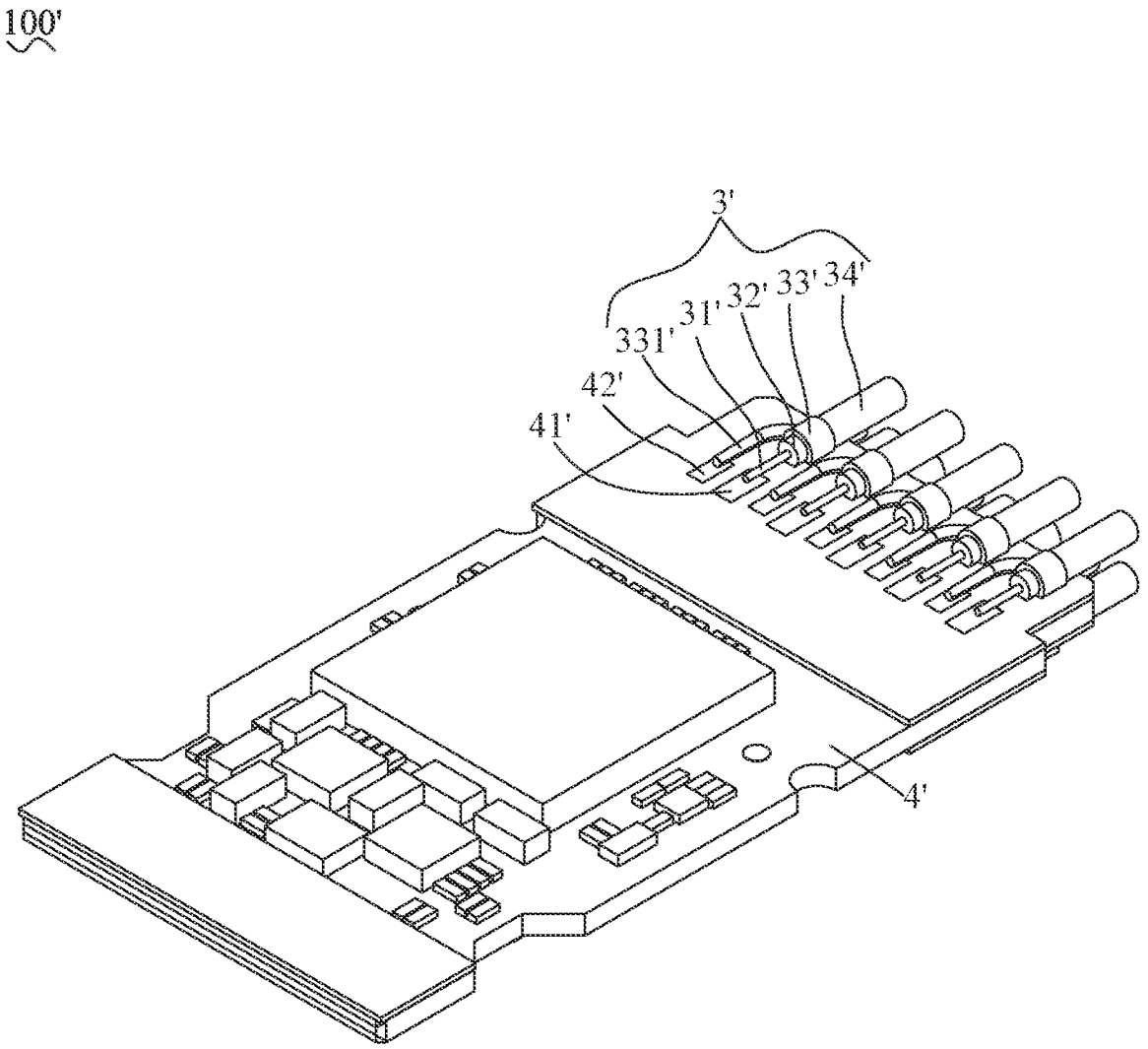
FIG. 10 (Prior Art)
FIG. 10 is a perspective view of a cable connector assembly in prior art.

With reference to FIG. 1, FIG. 2 and FIG. 9, a cable connector assembly 100 in accordance with a preferred embodiment of the present invention is shown. The cable connector assembly 100 is adapted for being cooperated with and locked with a docking connector 200. The cable connector assembly 100 includes a body 1, and an unlocking mechanism 2 mounted to the body 1.

The body 1 has a front end 11, and a rear end 12 opposite to the front end 11. When the docking connector 200 is assembled with the body 1 of the cable connector assembly 100, the front end 11 of the body 1 is adapted for being cooperated with the docking connector 200. The rear end 12 of the body 1 is connected to a plurality of cables 3. The body 1 includes a lower cover 15, and an upper cover 16 covered to the lower cover 15. The upper cover 16 of the body 1 has two side walls 13 and a top wall 14. The two side walls 13 are vertically positioned opposite to each other. The top wall 14 is connected between tops of the two side walls 13. Two outer side surfaces of the body 1 are recessed inward to form two sliding grooves 131 penetrating through a rear surface of the body 1. Two outer surfaces of the two side walls 13 of the body 1 are recessed inward to form two first sliding grooves 132 penetrating through bottoms and rears of the two outer surfaces of the two side walls 13 of the body 1. Two outer side surfaces of the lower cover 15 are recessed inward to form two second sliding grooves 133 corresponding to the two first sliding grooves 132, respectively. The two first sliding grooves 132 and the two second sliding grooves 133 are combined to form the two sliding grooves 131.

The unlocking mechanism 2 has two driving arms 21 positioned vertically and opposite to each other. The two driving arms 21 are able to slide frontward and rearward along two sides of the body 1. The two driving arms 21 are received in the two sliding grooves 131 of the body 1, respectively, and the two driving arms 21 are able to slide in the two sliding grooves 131. Rears of top edges of the two driving arms 21 protrude upward, and then are bent towards each other to form a connecting arm 22. The connecting arm 22 is formed between tops of two rear ends of the two driving arms 21.

Rear edges of the two rear ends of the two driving arms 21 are connected with an operating portion 23 protruded outward. The operating portion 23 is of a U shape from a vertical view. A mouth of the U-shaped operating portion 23 faces frontward. A rear end of the operating portion 23 is far away from the connecting arm 22. Specifically, the rear edges of the two rear ends of the two driving arms 21 protrude rearward and then are bent towards each other to form the operating portion 23. Front edges of two free ends of the two driving arms 21 protrude forward to form two unlocking portions 24. Middles of the two unlocking portions 24 are arched oppositely to form two buckling portions 241. The two buckling portions 241 are used to abut against elastic pieces (not shown) of the docking connector 200 to realize that the two buckling portions 241 of the cable connector assembly 100 is locked with and cooperated with the docking connector 200.

The two driving arms 21 and the two unlocking portions 24 are mounted in the two sliding grooves 131. When the unlocking mechanism 2 is in an initial position, the two driving arms 21 are made to slide to unlocking positions by virtue of exerting an outward force on the operating portion 23, at the moment, the two buckling portions 241 of the two driving arms 21 are able to push away the elastic pieces of the docking connector 200 along an outward and rearward direction, so that the body 1 of the cable connector assembly 100 is able to be withdrawn from the docking connector 200.

Figure 3:
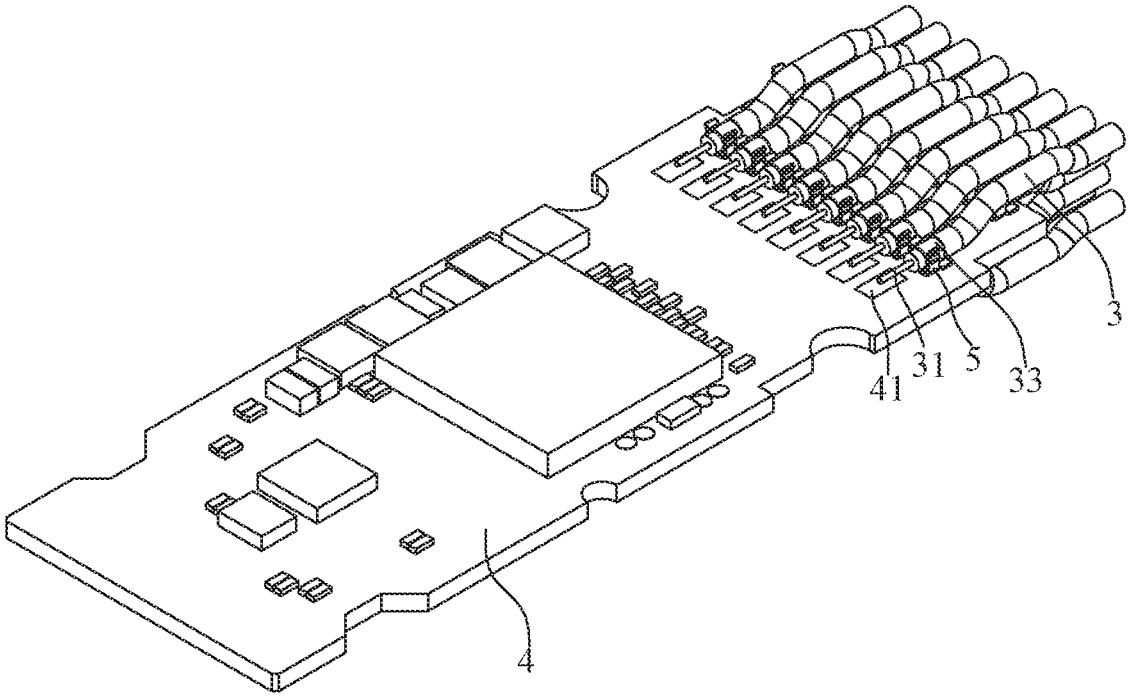
FIG. 3 is a partially assembling view showing that a plurality of cables are connected to a circuit board of the cable connector assembly of FIG. 2.
Figure 4:
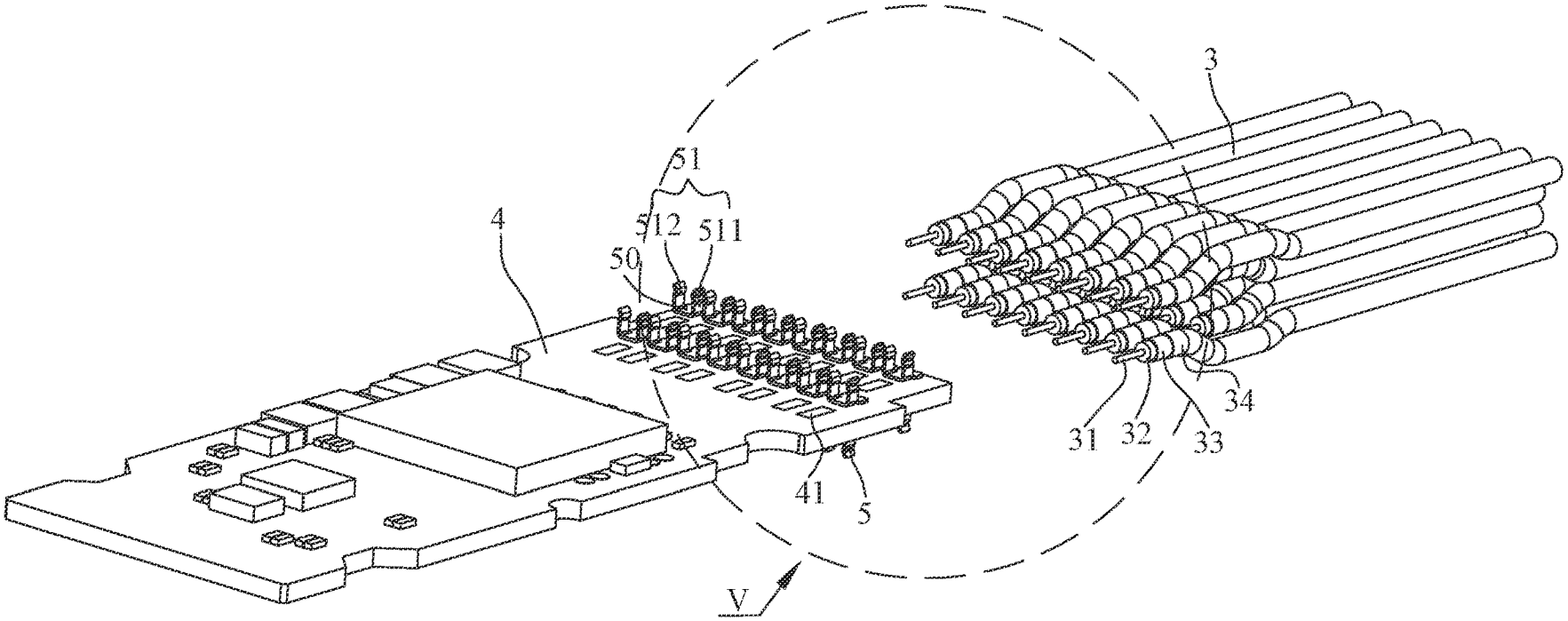
FIG. 4 is a partially exploded view showing that the plurality of the cables are moved away from the circuit board of the cable connector assembly of FIG. 3.
Figure 5:
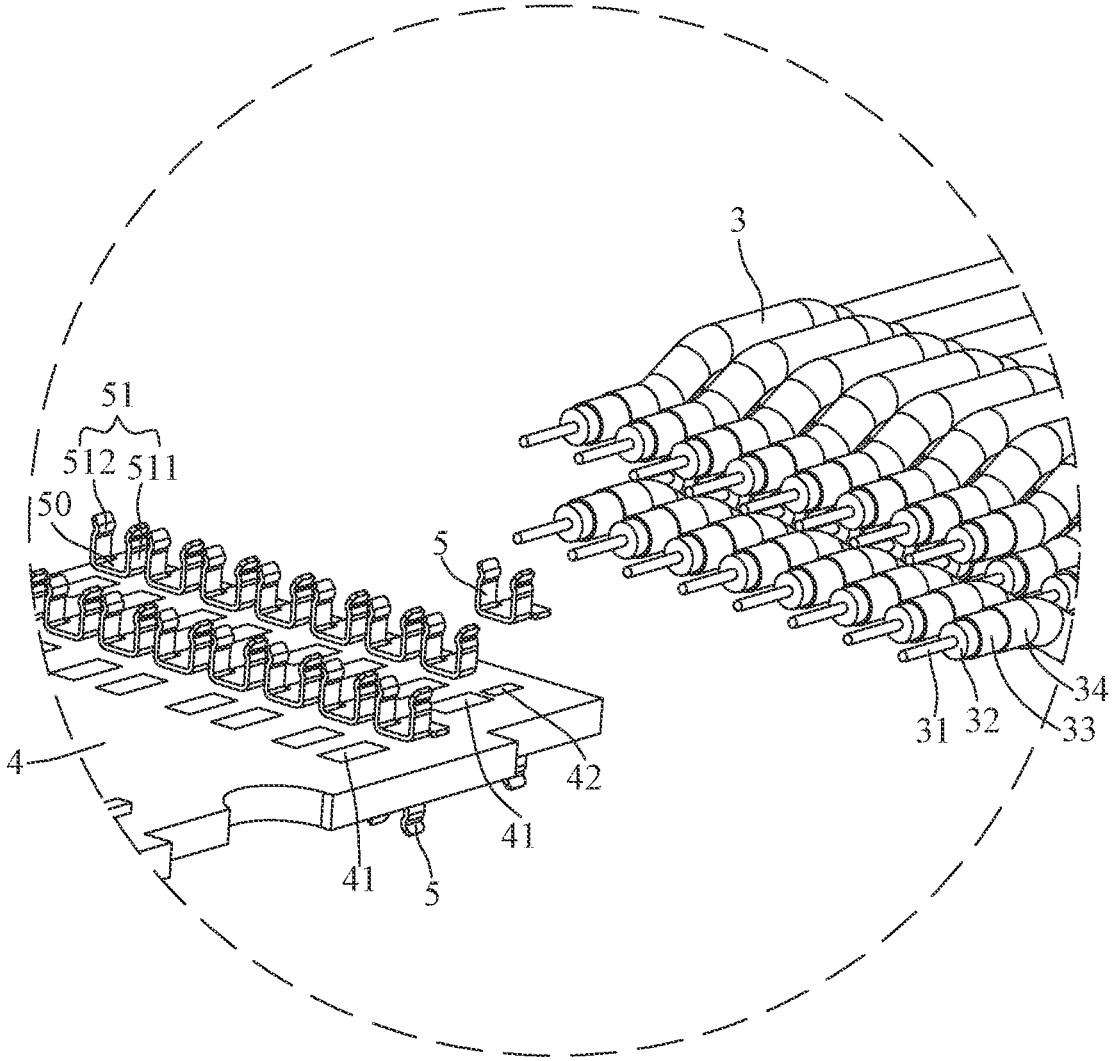
FIG. 5 is an enlarged view of an encircled portion V of the cable connector assembly of FIG. 4.
Figure 6:
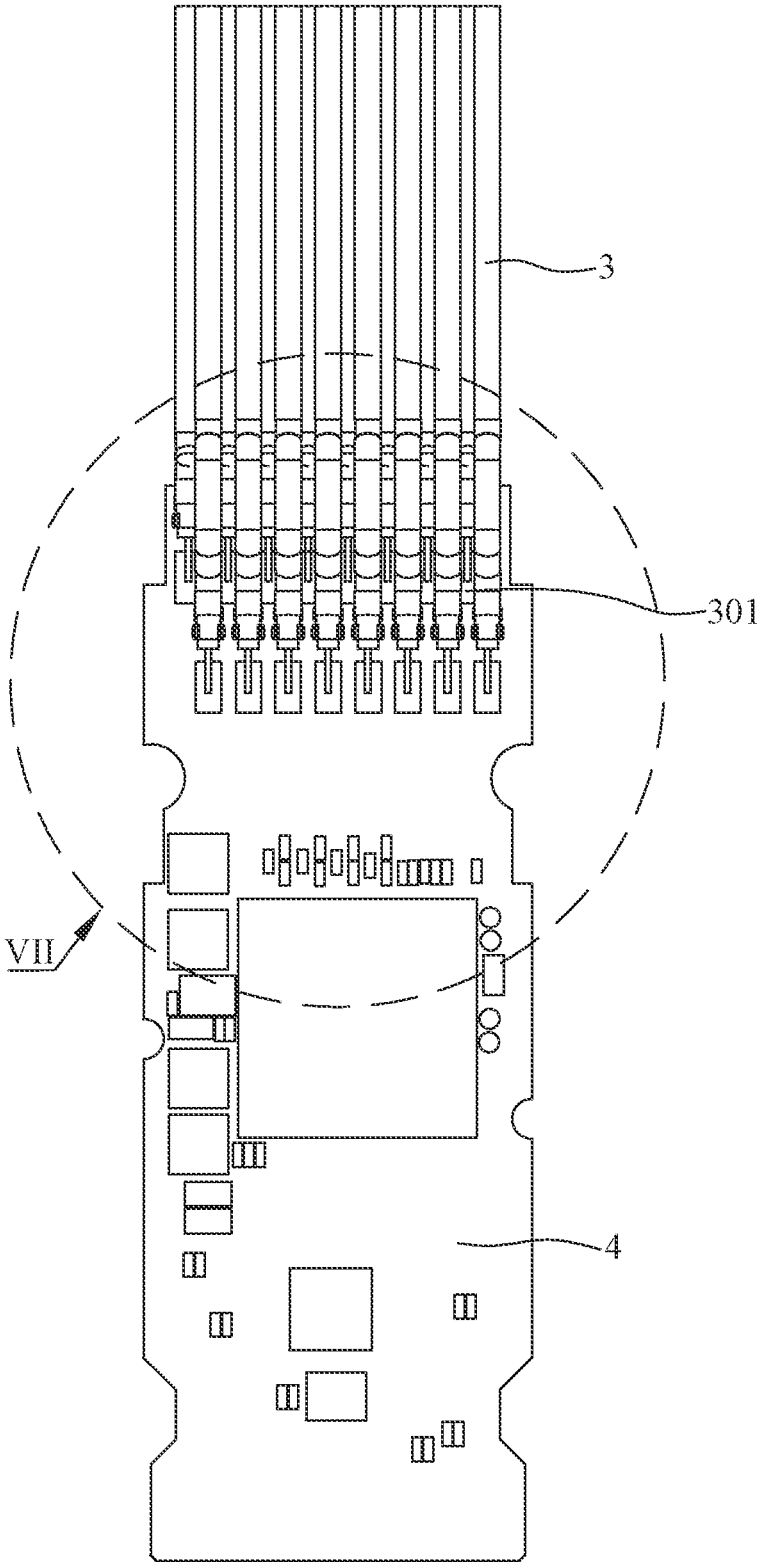
FIG. 6 is a partially perspective view of the cable connector assembly of FIG. 1, wherein the plurality of the cables are soldered to the circuit board of the cable connector assembly in accordance with the present invention.
Figure 7:
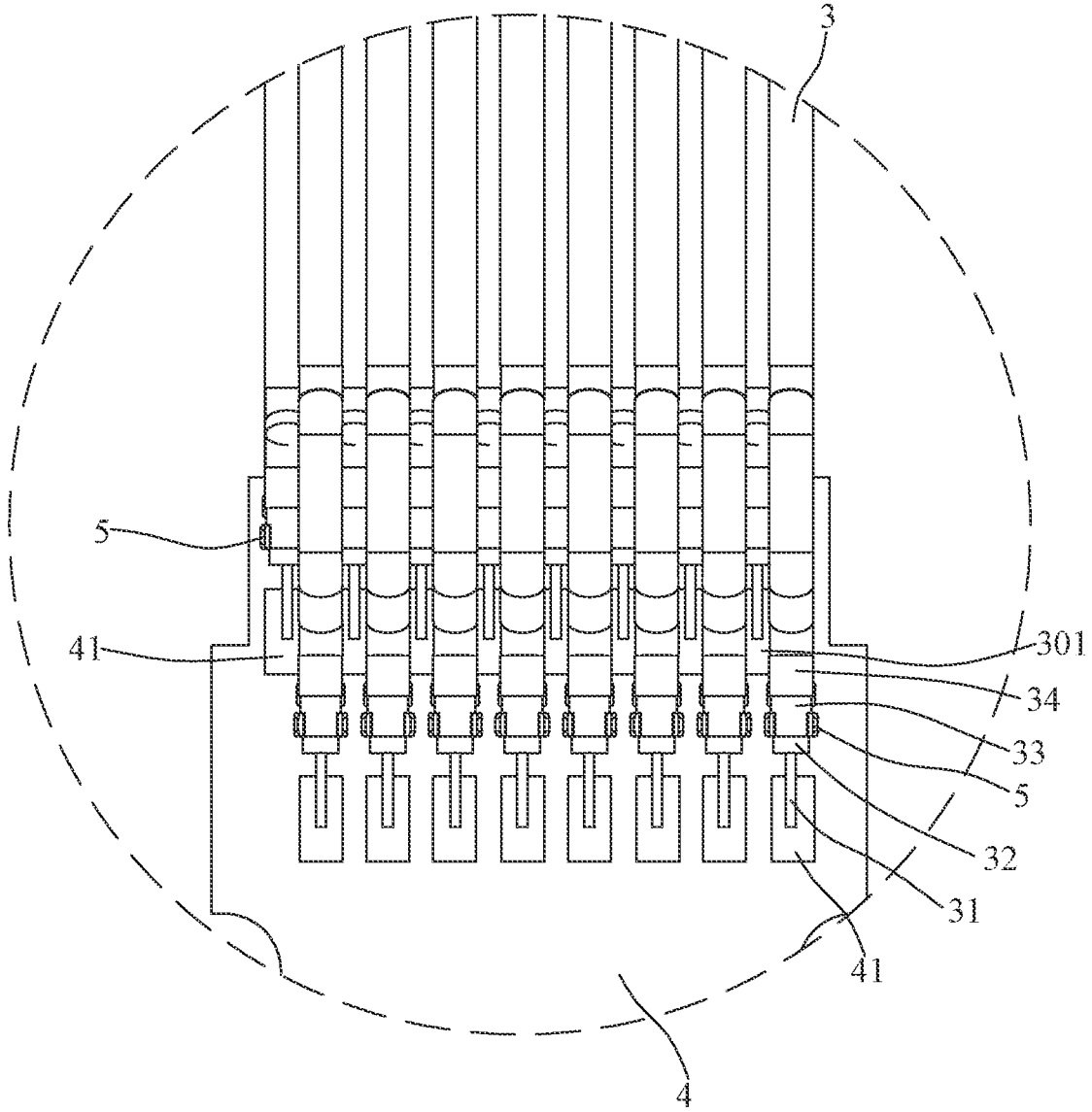
FIG. 7 is an enlarged view of an encircled portion VII of the cable connector assembly of FIG. 6.
Figure 8:
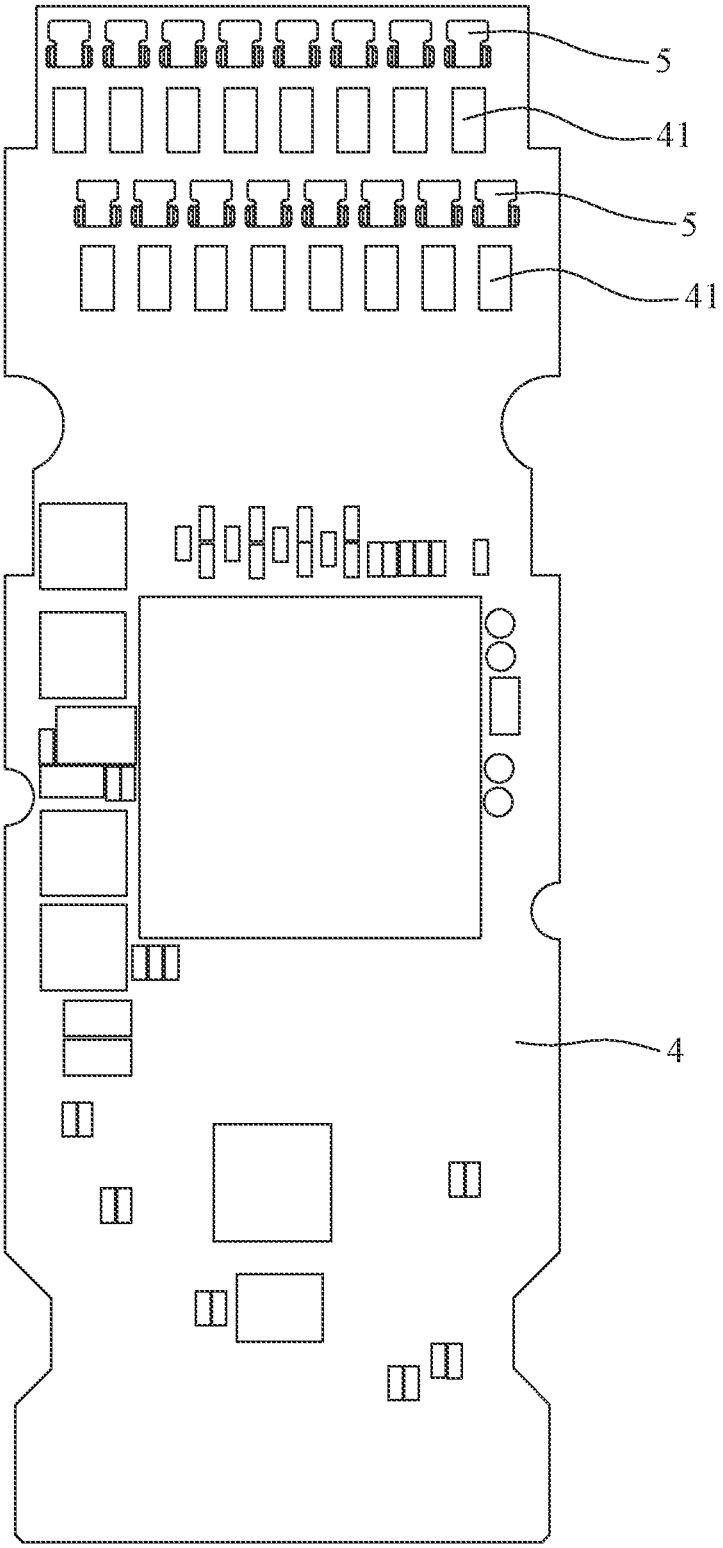
FIG. 8 is another partially perspective view of the cable connector assembly of FIG. 1, wherein a plurality of grounding elements are soldered to the circuit board of the cable connector assembly in accordance with the present invention.

With reference to FIG. 3 to FIG. 5, the cable connector assembly 100 further includes a circuit board 4 accommodated in the body 1 and electrically connected with the plurality of the cables 3, and a plurality of grounding elements 5 accommodated in the body 1, and electrically connected to the circuit board 4 and the plurality of the cables 3. The circuit board 4 is mounted in the lower cover 15. The upper cover 16 is mounted on the lower cover 15, so the circuit board 4 is mounted between the upper cover 16 and the lower cover 15. The body 1 surrounds the circuit board 4. A rear end of at least one surface of the circuit board 4 is equipped with a plurality of contact pads 41. Rear ends of an upper surface and a lower surface of the circuit board 4 are equipped with the plurality of the contact pads 41, and a plurality of grounding pads 42 near to the plurality of the contact pads 41. The plurality of the grounding pads 42 are arranged in two rows and along a front-to-rear direction, and the plurality of the contact pads 41 are arranged in two rows and along the front-to-rear direction.

The plurality of the contact pads 41 are corresponding to the plurality of the grounding pads 42. The contact pads 41 in each row are arranged transversely, and the grounding pads 42 in each row are arranged transversely. Each grounding pad 42 is located around one contact pad 41. One row of the grounding pads 42 is located behind the two rows of the contact pads 41. The other row of the grounding pads 42 is located between the two rows of the contact pads 41. Preferably, one contact pad 41 of one row of the contact pads 41, one grounding pad 42 of the one row of the grounding pads 42, one contact pad 41 of the other row of the contact pads 41 and one grounding pad 42 of the other row of the grounding pads 42 are longitudinally arranged in one line and in sequence. Each line of the one contact pad 41 of the one row of the contact pads 41, the one grounding pad 42 of the one row of the grounding pads 42, the one contact pad 41 of the other row of the contact pads 41 and the one grounding pad 42 of the other row of the grounding pads 42 are in alignment with one another.

With reference to FIG. 3 to FIG. 8, in this case, the plurality of the contact pads 41 and the plurality of the grounding pads 42 are arranged in a first group and a second group. The contact pads 41 of the first group are arranged in the one row. The grounding pads 42 of the first group are arranged in the one row. In the first group, the one row of the contact pads 41 and the one row of the grounding pads 42 are arranged along the front-to-rear direction. In the first group, each contact pad 41 of the one row of the contact pads 41 is aligned with the one grounding pad 42 of the one row of the grounding pads 42 along the front-to-rear direction. The contact pads 41 of the second group are arranged in the other row. The grounding pads 42 of the second group are arranged in the other row. In the second group, the other row of the contact pads 41 and the other row of the grounding pads 42 are arranged along the front-to-rear direction. In the second group, each contact pad 41 of the other row of the contact pads 41 is aligned with the one grounding pad 42 of the other row of the grounding pads 42 along the front-to-rear direction. The contact pads 41 of the first group and the contact pads 41 of the second group are staggered along the front-to-rear direction. Therefore, the grounding pads 42 of the first group and the grounding pads 42 of the second group are staggered along the front-to-rear direction.

The plurality of the grounding elements 5 are soldered to the plurality of the grounding pads 42 of the circuit board 4 by a SMT (Surface Mounted Technology) procedure. Two sides of each grounding element 5 have two clamping portions 51 protruded upward. Specifically, each grounding element 5 has a base portion 50, and the two clamping portions 51 extended upward from two opposite sides of the base portion 50. The base portion 50 of each grounding element 5 is soldered to one grounding pad 42 of the circuit board 4. The two clamping portions 51 include two extending arms 511 extended upward from the two opposite sides of the base portion 50, and the two extending arms 511 are opposite to each other. Upper portions of the two extending arms 511 are arched inwardly and towards each other to form two clamping blocks 512, respectively. The two clamping blocks 512 face to each other. The two clamping blocks 512 of each grounding element 5 abut against the shielding layer 33 of one cable 3. The upper surface and the lower surface of the circuit board 4 are soldered with the plurality of the grounding elements 5.

The plurality of the cables 3 are soldered to the circuit board 4. The plurality of the cables 3 are received in the body 1 and rear ends of the plurality of the cables 3 are exposed out of the body 1. Each cable 3 is a coaxial cable. Each cable 3 includes an inner conductor 31, an inner insulating layer 32, a shielding layer 33, and an outer insulating layer 34 arranged in an inside-to-outside direction and in sequence. The shielding layer 33 is a mesh-shaped conductor. The shielding layer 33 of each cable 3 is earthed to make external interference signals to be introduced into a ground through the shielding layer 33 so as to prevent the interference signals from entering the inner conductor 31 of each cable 3 and further reduce losses of transmission signals of each cable 3.

The inner conductors 31 of the plurality of the cables 3 are electrically connected with the plurality of the contact pads 41 of the circuit board 4, at the moment, the shielding layer 33 of each cable 3 is mounted downward in one grounding element 5. The shielding layer 33 of each cable 3 is soldered with the one grounding element 5. The shielding layer 33 of each cable 3 is clamped between the two clamping portions 51 of the one grounding element 5, and the shielding layer 33 of each cable 3 is in contact with the two clamping portions 51 of the one grounding element 5, in this way, the shielding layer 33 of each cable 3 of the cable connector assembly 100 reaches a grounding effect by virtue of the two clamping portions 51 of the one grounding element 5 contacting with the shielding layer 33 of each cable 3. Each grounding element 5 is located under the shielding layer 33 of the one cable 3, so a required space of each cable 3 on the circuit board 4 is reduced, and then a space utilization rate of the circuit board 4 is increased. The plurality of the cables 3 are fastened on the circuit board 4 and are arranged in two rows along the front-to-rear direction.

Because the contact pads 41 of the first group and the contact pads 41 of the second group are staggered along the front-to-rear direction, and the grounding pads 42 of the first group and the grounding pads 42 of the second group are staggered along the front-to-rear direction, the plurality of the cables 3 are arranged in a first row and a second row. The cables 3 of the first row and the cables 3 of the second row are staggered. Each two adjacent cables 3 in the first row are spaced from each other to form a gap 301 therebetween. The gaps 301 among the cables 3 of the first row are transversely distributed from one side of the cables 3 of the first row to the other side of the cables 3 of the first row. An area closest to the cable 3 located at an outermost position of the other side of the cables 3 of the first row is also defined as the gap 301. The cables 3 of the second row are positioned in the gaps 301 of each two adjacent cables 3 in the first row and the area closest to the cable 3 located at the outermost position of the other side of the cables 3 of the first row.

Specifically, in this preferred embodiment, the plurality of the cables 3 are eight 28 AWG cables 3 connected to the circuit board 4. Compare the cable connector assembly 100 with the cable connector assembly 100' in prior art, the circuit board 4 is connected with more cables 3, so that the cable connector assembly 100 reaches a better transmission effect under a condition of a usage space of the circuit board 4 of the cable connector assembly 100 and a usage space of the circuit board 4' of the cable connector assembly 100' being the same.

As described above, the cable connector assembly 100 reaches the grounding effect by virtue of the plurality of the grounding elements 5 being soldered to the plurality of the grounding pads 42 of the circuit board 4 and directly contacting with the shielding layers 33 of the plurality of the cables 3 to be conductive, so the shielding layers 33 of the plurality of the cables 3 have no need of being deliberately arranged into a bundle in addition, and a manufacturing procedure of the cable connector assembly 100 is simpler, and simultaneously, the cable connector assembly 100 simplifies a cable grounding mode. Furthermore, each grounding element 5 is located under the shielding layer 33 of the one cable 3, so the required space of each cable 3 on the circuit board 4 is reduced, and the space utilization rate of the circuit board 4 is increased correspondingly.

What is claimed is:

1. A cable connector assembly, comprising:

a circuit board, rear ends of an upper surface and a lower surface of the circuit board being equipped with a plurality of contact pads, and a plurality of grounding pads near to the plurality of the contact pads;

a plurality of grounding elements soldered to the plurality of the grounding pads of the circuit board, two sides of each grounding element having two clamping portions protruded upward; and a plurality of cables fastened on the circuit board, each cable including an inner conductor, an inner insulating layer, a shielding layer and an outer insulating layer arranged in an inside-to-outside direction and in sequence, the inner conductors of the plurality of the cables being electrically connected with the plurality of the contact pads of the circuit board, the shielding layer of each cable being mounted in one grounding element, the shielding layer of each cable being clamped between the two clamping portions of the one grounding element, and the shielding layer of each cable being in contact with the two clamping portions of the one grounding element;

wherein each grounding element has a base portion and the two clamping portions extended upward from two opposite sides of the base portion, the base portion of each grounding element is soldered to one grounding pad of the circuit board, the two clamping portions include two extending arms extended upward from the two opposite sides of the base portion, the two extending arms are opposite to each other, upper portions of the two extending arms are arched inwardly and towards each other to form two clamping blocks, respectively, the two clamping blocks face each other, and the two clamping blocks abut against the shielding layer of each cable.

2. The cable connector assembly as claimed in claim 1, wherein the plurality of the grounding pads are arranged in two rows and along a front-to-rear direction, and the plurality of the contact pads are arranged in two rows and along the front-to-rear direction, the plurality of the contact pads are corresponding to the plurality of the grounding pads, the contact pads in each row are arranged transversely, and the grounding pads in each row are arranged transversely, one row of the grounding pads is located behind the two rows of the contact pads, the other row of the grounding pads is located between the two rows of the contact pads.

3. The cable connector assembly as claimed in claim 2, wherein one contact pad of one row of the contact pads, one grounding pad of the one row of the grounding pads, one contact pad of the other row of the contact pads and one grounding pad of the other row of the grounding pads are longitudinally arranged in one line and in sequence.

4. The cable connector assembly as claimed in claim 3, wherein each line of the one contact pad of the one row of the contact pads, the one grounding pad of the one row of the grounding pads, the one contact pad of the other row of the contact pads and the one grounding pad of the other row of the grounding pads are in alignment with one another.

5. The cable connector assembly as claimed in claim 1, wherein the shielding layer is a mesh-shaped conductor.

6. The cable connector assembly as claimed in claim 1, wherein each cable is a coaxial cable.

7. The cable connector assembly as claimed in claim 1, further comprising a body surrounding the circuit board, the body having a front end, and a rear end opposite to the front end, the front end of the body being adapted for being cooperated with a docking connector, the rear end of the body being connected to the plurality of the cables.

8. The cable connector assembly as claimed in claim 7, wherein the body includes a lower cover, and an upper cover covered to the lower cover, the upper cover of the body has two side walls vertically positioned opposite to each other, and a top wall connected between tops of the two side walls.

9. The cable connector assembly as claimed in claim 8, wherein two outer side surfaces of the body are recessed inward to form two sliding grooves penetrating through a rear surface of the body, the cable connector assembly further includes an unlocking mechanism mounted to the body, the unlocking mechanism has two driving arms positioned vertically and opposite to each other, the two driving arms are received in the two sliding grooves of the body, respectively.

10. The cable connector assembly as claimed in claim 9, wherein two outer surfaces of the two side walls of the body are recessed inward to form two first sliding grooves penetrating through bottoms and rears of the two outer surfaces of the two side walls of the body, two outer side surfaces of the lower cover are recessed inward to form two second sliding grooves corresponding to the two first sliding grooves, respectively, the two first sliding grooves and the two second sliding grooves are combined to form the two sliding grooves.

11. The cable connector assembly as claimed in claim 10, wherein the two driving arms are able to slide frontward and rearward along two sides of the body, rears of top edges of the two driving arms protrude upward, and then are bent towards each other to form a connecting arm, rear edges of two rear ends of the two driving arms protrude rearward and then are bent towards each other to form an operating portion, front edges of two free ends of the two driving arms protrude forward to form two unlocking portions, middles of the two unlocking portions are arched oppositely to form two buckling portions, the two driving arms and the two unlocking portions are mounted in the two sliding grooves, when the unlocking mechanism is in an initial position, the two driving arms are made to slide to unlocking positions by virtue of exerting an outward force on the operating portion.

12. The cable connector assembly as claimed in claim 11, wherein the operating portion is of a U shape from a vertical view.

13. The cable connector assembly as claimed in claim 1, wherein the plurality of the grounding elements are soldered to the plurality of the grounding pads of the circuit board by a SMT (Surface Mounted Technology) procedure.

14. The cable connector assembly as claimed in claim 1, wherein the shielding layer of each cable is soldered with the one grounding element.

15. The cable connector assembly as claimed in claim 1, wherein each grounding pad is located around one contact pad.

16. A cable connector assembly, comprising:

a circuit board, rear ends of an upper surface and a lower surface of the circuit board being equipped with a plurality of contact pads, and a plurality of grounding pads near to the plurality of the contact pads, the plurality of the grounding pads being arranged in two rows and along a front-to-rear direction, and the plurality of the contact pads being arranged in two rows and along the front-to-rear direction, the plurality of the contact pads being corresponding to the plurality of the grounding pads, the contact pads in each row being arranged transversely, and the grounding pads in each row being arranged transversely, one row of the grounding pads being located behind the two rows of the contact pads, the other row of the grounding pads being located between the two rows of the contact pads;

a plurality of grounding elements soldered to the plurality of the grounding pads of the circuit board, each grounding element having a base portion, and two clamping portions extended upward from two opposite sides of the base portion, the base portion of each grounding element being soldered to one grounding pad of the circuit board, the two clamping portions including two extending arms extended upward from the two opposite sides of the base portion, upper portions of the two extending arms being arched inwardly and towards each other to form two clamping blocks, respectively; and a plurality of cables fastened on the circuit board and arranged in two rows along the front-to-rear direction, each cable including an inner conductor, an inner insulating layer, a shielding layer and an outer insulating layer arranged in an inside-to-outside direction and in sequence, the inner conductors of the plurality of the cables being electrically connected with the plurality of the contact pads of the circuit board, the shielding layer of each cable being mounted in one grounding element, the shielding layer of each cable being clamped between the two clamping portions of the one grounding element, and the shielding layer of each cable being in contact with the two clamping portions of the one grounding element, the two clamping blocks of each grounding element abutting against the shielding layer of one cable.

17. A cable connector assembly, comprising:

a body;

a circuit board accommodated in the body, a rear end of at least one surface of the circuit board being equipped with a plurality of contact pads, and a plurality of grounding pads near to the plurality of the contact pads, the plurality of the grounding pads being arranged in two rows and along a front-to-rear direction, and the plurality of the contact pads being arranged in two rows and along the front-to-rear direction, the plurality of the contact pads being corresponding to the plurality of the grounding pads, the contact pads in each row being arranged transversely, and the grounding pads in each row being arranged transversely, one row of the grounding pads being located behind the two rows of the contact pads, the other row of the grounding pads being located between the two rows of the contact pads;

a plurality of grounding elements accommodated in the body, the plurality of the grounding elements being soldered to the plurality of the grounding pads of the circuit board, two sides of each grounding element having two clamping portions protruded upward; and a plurality of cables soldered to the circuit board, the plurality of the cables being received in the body, each cable including an inner conductor, an inner insulating layer, a shielding layer and an outer insulating layer arranged in an inside-to-outside direction and in sequence, the inner conductors of the plurality of the cables being electrically connected with the plurality of the contact pads of the circuit board, the shielding layer of each cable being mounted in one grounding element, the shielding layer of each cable being clamped between the two clamping portions of the one grounding element, the shielding layer of each cable being soldered with the one grounding element, and the shielding layer of each cable being in contact with the two clamping portions of the one grounding element;

wherein each grounding element has a base portion and the two clamping portions extended upward from two opposite sides of the base portion, the base portion of each grounding element is soldered to one grounding pad of the circuit board, the two clamping portions include two extending arms extended upward from the two opposite sides of the base portion, the two extending arms are opposite to each other, upper portions of the two extending arms are arched inwardly and towards each other to form two clamping blocks, respectively, the two clamping blocks face each other, and the two clamping blocks abut against the shielding layer of each cable.

* * * * *